United States Patent [19]

Erdmann et al.

[11] 4,312,699

[45] Jan. 26, 1982

[54] APPARATUS FOR ATTACHING ADHESIVE-COATED SHEETS TO CIGARETTE PACKS OR THE LIKE

[75] Inventors: Otto Erdmann, Hamburg; Reinhard Deutsch, Geesthacht, both of Fed. Rep. of Germany

[73] Assignee: Hauni-Werke Körber & Co. K.G., Hamburg, Fed. Rep. of Germany

[21] Appl. No.: 109,921

[22] Filed: Jan. 7, 1980

[30] Foreign Application Priority Data

Jan. 18, 1979 [DE] Fed. Rep. of Germany ..... 2901825

[51] Int. Cl.[3] ..... B65C 9/36

[52] U.S. Cl. ..... 156/477 R; 53/137; 156/364; 156/486; 156/568; 156/578; 156/DIG. 4; 271/315

[58] Field of Search ..... 156/477 R, 364, 568, 156/486, 578, 567, DIG. 4; 53/137; 271/315

[56] References Cited

U.S. PATENT DOCUMENTS

| | | | |
|---|---|---|---|
| 1,467,018 | 9/1923 | Tzibides | 156/477 R |
| 1,652,040 | 12/1927 | Molins | 156/364 |
| 2,031,136 | 2/1936 | Sewick | 271/315 |
| 2,787,396 | 4/1957 | Christensson | 156/486 |
| 4,181,561 | 1/1980 | Seragnoli | 156/DIG. 4 |

*Primary Examiner*—John J. Gallagher
*Attorney, Agent, or Firm*—Peter K. Kontler

[57] ABSTRACT

Apparatus for applying labels to successive cigarette packs has a feeding unit which delivers a series of labels downwardly past an adhesive-applying device which coats one side of each label with a hotmelt and through a stationary mouthpiece which directs the oncoming label into one of two pockets on a turntable which is indexible through 180 degrees. The pockets are shorter than the labels so that the outer end portion of the label extends beyond the respective pocket and is placed against one side of a reciprocable back support after the turntable is indexed. A pusher then delivers a cigarette pack against the adhesive-coated side of the outer end portion of the label which abuts against the back support so that the outer end portion is caused to adhere to one side face of the pack. The label is thereupon folded over additional sides of the pack while the latter moves past and beyond the turntable and pushes the back support in the same direction. The latter is thereupon retracted, moved counter to the direction of forward movement of the pusher and reinserted into the path of packs so that it is ready to support the uncoated side of the outer end portion of the next label which arrives when the turntable is indexed again through an angle of 180 degrees.

20 Claims, 3 Drawing Figures

1
2
2a
2b
2c
2d
3
4
6
7
8
9
10
10a
11
12
13
14
15
16
17
18
19
19a
19b
21
23
24
26
27
28
29
30
31
32
33
34
36
37
37a
38
39
41
42
42a
43
43a
43b
44
44'
48
49
50
51
52
101
102
I
II
III

APPARATUS FOR ATTACHING ADHESIVE-COATED SHEETS TO CIGARETTE PACKS OR THE LIKE

BACKGROUND OF THE INVENTION

The present invention relates to apparatus for attaching adhesive-coated sheets to brick-shaped, block-shaped or similarly configurated commodities, especially for applying adhesive-coated labels to packs which contain cigarettes or other smokers' articles. More particularly, the invention relates to improvements in apparatus for applying adhesive-coated labels or other types of adherent sheet-like products to cigarette packs or similar commodities while the commodities move through a labelling or attaching station.

It is already known to employ a first conveyor system which advances cigarette packs through a labelling station, and to resort to a second conveyor system which delivers adhesive-coated sheets to successive packs at the labelling station. The sheets may constitute elongated ribbons which are used to seal the respective ends of packs and/or customary revenue labels which must be applied to packs prior to shipment of packs to customers or into storage. A drawback of presently known labelling apparatus is that they are relatively slow, especially if each and every label is to be applied in a predetermined orientation. In other words, presently known labelling apparatus cause a pronounced reduction of the output of a complete production line, e.g., a production line wherein one or more cigarette makers turn out plain cigarettes, one or more makers turn out filter plugs, one or more filter tipping machines assemble filter plugs with plain cigarettes to form filter cigarettes, one or more packing machines assemble arrays of filter cigarettes and insert such arrays into discrete packs, and one or more labelling apparatus attach labels to successive packs prior to introduction of packs into cartons or other types of receptacles. If the speed of presently known labelling apparatus is increased, improperly applied labels detract from the eye-pleasing appearance of the ultimate products. In many instances, the manner in which the labels are applied is so unsatisfactory that the respective packs must be discarded. As a rule, the labels will lie askew if the speed of a conventional labelling apparatus is increased to that at which the apparatus processes the output of a modern high-speed packing machine.

OBJECTS AND SUMMARY OF THE INVENTION

An object of the invention is to provide a novel and improved apparatus for attaching adherent sheets to block-shaped or similar commodities, such as packs for cigarettes or the like, which is constructed and assembled in such a way that it can affix adherent sheets at a high frequency and with a high degree of predictability.

Another object of the invention is to provide an apparatus which can be used with particular advantage for the application of labels to packs for cigarettes or the like and at the rate at which the packs issue from a high-speed packing machine.

A further object of the invention is to provide a labelling apparatus which can be used in existing production lines for mass-manufacture of smokers' articles as a superior substitute for existing labelling apparatus.

An additional object of the invention is to provide the apparatus with novel and improved means for manipulating adhesive-coated labels or analogous adherent sheet-like articles preparatory to and during application to successive block-shaped or similar commodities.

A further object of the invention is to provide a labelling apparatus which is relatively simple and compact, which treats the labels gently, and which can be used with equal advantage for the application of relatively large, relatively small, relatively long or relatively short labels, ribbons or analogous adherent sheet-like articles.

An ancillary object of the invention is to provide the apparatus with novel and improved means for changing the orientation of successive labels during transport from the paster to the locale of attachment of labels to successive cigarette packs or analogous commodities.

The invention is embodied in an apparatus for attaching flexible sheets of the type having adherent and non-adherent sides and first and second end portions to block-shaped or brick-shaped commodities, particularly for applying revenue labels or the like to packs which contain arrays of cigarettes or other smokers' products. The apparatus comprises a plurality of pairwise arranged advancing rolls or other suitable means for feeding successive sheets toward but short of a station for attachment of consecutively delivered sheets to successive commodities (such station can be defined by a substantially horizontal platform which supports the commodities during attachment of sheets thereto), means for transferring successive sheets from the feeding means to successive commodities at the aforementioned station (such transferring means includes a carrier, preferably a turntable, which exposes and thus renders accessible both sides of the first end portion of each sheet which is being transferred to the aforementioned attaching station), a preferably plate-like back support which is disposed at the attaching station and is adjacent to and serves as an abutment for the non-adherent side of the first end portion of a freshly transferred sheet, and suitable means (e.g., a conveyor including a pusher) for moving successive commodities against the adherent sides of first end portions of sheets which are adjacent to or already abut against the back support.

The aforementioned pusher of the moving means for successive commodities is designed to convey the commodities through the station in a predetermined direction and along a predetermined path, and the apparatus further comprises means for moving the back support into and from such path. In addition, the back support is preferably movable with successive commodities along a certain portion of the path for the commodities while a commodity is conveyed in the aforementioned direction so that the adherent side of the first end portion of the sheet which abuts against the back support is held in contact with the respective commodity.

In accordance with a presently preferred embodiment of the invention, the carrier is or includes a turntable which is indexible about a predetermined axis (e.g., about a horizontal axis if the sheets are fed vertically downwardly) and has at least one receiving means for sheets. The receiving means is positioned to accept a sheet from the feeding means in a first angular position of the turntable and to maintain the first end portion of such sheet in abutment with (or close to) the back support in a different second angular position of the turntable, namely, subsequent to one or more indexing movements of the turntable from the first position, depending upon the number of receiving means in or on the turntable. Each receiving means may constitute a pocket which is open at one end and at one side and is shorter than a sheet so that the first end portion of the inserted sheet extends from the pocket. The apparatus preferably further comprises means for temporarily clamping the sheets in or to the pocket or pockets of the turntable so that the position of the sheets relative to their receiving means does not change during indexing of the turntable and prior to attachment of adherent sides of the first end portions of sheets to the respective commodities.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
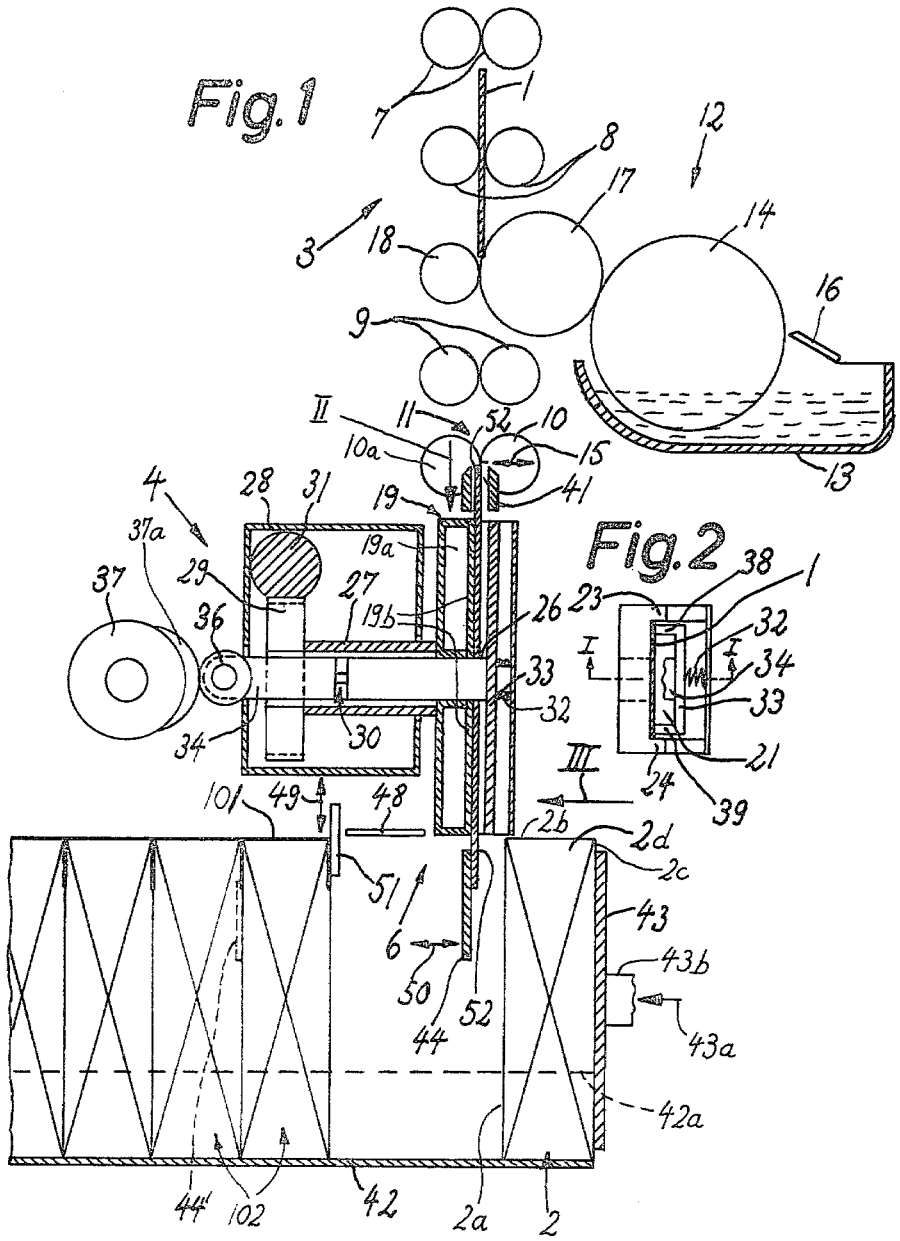
FIG. 1 is a partly elevational and partly vertical sectional view of a labelling apparatus which embodies the invention, the section being taken in the direction of arrows as seen from the line I—I of FIG. 2.
FIG. 2 is a plan view of a portion of the sheet transferring means as seen in the direction of arrow II in FIG. 1.

The apparatus which is shown in the drawing is designed to apply elongated flexible sheets in the form of labels 1 to successive block-shaped commodities which constitute soft cigarette packs 2. The manner in which the labels 1 are formed, e.g., by subdividing an elongated ribbon into discrete sections, each of which constitutes a label, forms no part of the present invention. The apparatus comprises a label feeding unit 3 which serves to advance successive labels 1 downwardly along a substantially vertical path and into the range of a label transferring unit 4 which accepts and reorients successive labels prior to attachment of such labels to successive soft packs 2 at a labelling or attaching station 6.

The feeding conveyor 3 comprises several pairs of driven advancing rolls including an uppermost pair 7, a second pair 8, a third pair 9 and a lowermost pair 11. The manner in which one or both rolls of each pair of advancing rolls 7, 8, 9, 11 are driven forms no part of the present invention. For example, it will normally suffice to drive one roll of each pair and to yieldably bias the other roll against the one roll. The right-hand roll 10 of the lowermost pair 11 is movable toward and away from the associated roll **10*a* in the directions which are indicated by a double-headed arrow 15**.

The distance between the pairs 8 and 9 of advancing rolls in the label feeding unit 3 is selected in such a way that the space between these pairs of rolls accomodates certain components of a paster 12 serving as a means for coating a selected portion of one side of each label 1 with a suitable adhesive, preferably a hotmelt. The adhesive is stored in a vessel 13 and is withdrawn by a roller 14 which is driven in a counterclockwise direction, as viewed in FIG. 1. The lower portion of the roller 14 dips into the supply of adhesive paste in the vessel 13 and the peripheral surface of the roller 14 withdraws a film of adhesive paste which is equalized by a preferably adjustable doctor blade 16 prior to transfer onto the periphery of a driven applicator roller 17. The latter transfers a pattern of adhesive to the right-hand side of the oncoming label 1 and cooperates with a counterroller 18 which is mounted at the left-hand side of the vertical path for the labels 1. It is equally within the purview of the invention to omit the paster 12 or to replace this paster with a differently constructed and assembled paster. The paster can be omitted if the labels are coated with a heat- and/or pressure-activatable adhesive prior to introduction into the nip of the advancing rolls 7.

The label transferring unit 4 comprises a carrier, here shown as a turntable 19, which is indexible about a substantially horizontal axis defined by a hollow shaft 27 which is journalled in a gear box 28 installed in a suitable frame, not shown. The illustrated turntable 19 comprises two receiving means 21, 22 for discrete labels 1; therefore, the turntable is indexible through angles of 180 degrees. If the number of receiving means is reduced to one, the turntable is indexible through 360 degrees, if the number of receiving means is increased to three, the turntable is indexible through angles of 120 degrees, and so on. The two receiving means 21 and 22 are disposed diametrically opposite each other with reference to the axis of the hollow shaft 27.

A label 1 can be temporarily attracted to the receiving means 21 or 22 by suction, i.e., each of these receiving means can be formed with suction ports which communicate with a suitable suction generating device (e.g., a fan) to attract a label during transport from the discharge end of the feeding unit 3 to the labelling station 6. The turntable 19 is hollow and, therefore, its interior can be readily evacuated by resorting to a suitable system for drawing air from the internal space **19*a***.

Figure 3:
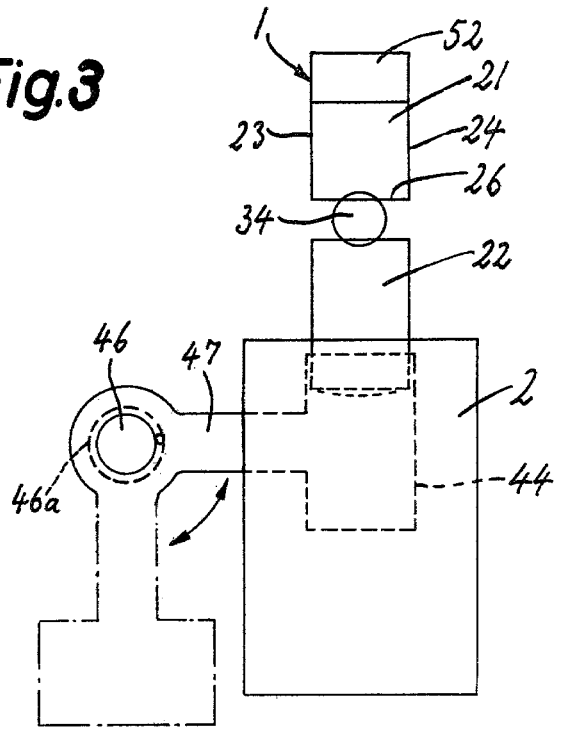
FIG. 3 is an end elevational view of a detail as seen in the direction of arrow III in FIG. 1.

In accordance with a feature of the present invention, the label transferring unit 4 is constructed and assembled in such a way that the turntable 19 need not constitute or comprise a suction chamber and its receiving means 21 and 22 need not be provided with suction ports or other means for attracting labels 1 by establishment of a pressure differential. This is accomplished by constructing the receiving means 21 and 22 in such a way that each thereof constitutes a pocket which extends substantially radially of the turntable 19 and is open at its outer end, i.e., at the end which is remotest from the axis of rotation of the turntable. In the illustrated embodiment, each pocket has a rear wall which is the right-hand wall **19*b* of the turntable 19, an inner end wall or stop 26 which is adjacent to the right-hand end portion of the shaft 27, and two side walls 23, 24 which extend at right angles to the respective inner end wall 26 and substantially radially of the shaft 27. The walls 23, 24 and 26 of the pocket 21 are shown in FIG. 2. A label 1, one side of which has been partially coated with adhesive during transport through the nip of the rollers 17, 18 and advances beyond the pair of rolls 9 and into the nip of the next pair 11, is caused to move through a vertical guide 41 here shown as a mouthpiece which is open at one side (e.g., at the side facing the observer of FIG. 1) so as to allow a label 1 which has entered the upper pocket (21 or 22) to share the angular movement of the turntable 19 through 180 degrees. This results in transfer of such label to the station 6. As shown in FIG. 2, a label 1 which has been introduced into the pocket 21** has an uncoated side which is adjacent to the rear wall 19*b* and a partially coated side which is the right-hand side, as viewed in FIG. 1 or 2. The vertical edge faces of such label are adjacent to the side walls 23, 24 and the uncoated portion or portions of the right-hand side of the label 1 in the pocket 21 are engaged by the legs or otherwise configurated projections 38, 39 of a clamping device 33 which is biased toward the label in the pocket 21 by one or more helical springs 32. The lower edge face of the label in the pocket 21 abuts against the inner end wall 26, and the uppermost or first end portion 52 of the label 1 is disposed between the lips of the mouthpiece 41. The legs 38, 39 of the clamping device 33 extend into the pocket 21. The construction of the pocket 22 is preferably analogous to or identical with that of the pocket 21. The pocket 22 of FIG. 3 is a mirror image of the pocket 21.

The clamping device 33 is reciprocable toward and away from the labels 1 in the pockets 21 and 22 by a rod-like shifting member 34 which is installed in the hollow shaft 27 and whose left-hand end portion, as viewed in FIG. 1, carries a roller follower 36 cooperating with the peripheral surface of a rotary disc-shaped cam 37. The turntable 19 is indexible by the hollow shaft 27 which carries a pinion 29 installed in the interior of the gear box 28 and meshing with a toothed rack 31 which is reciprocable in directions at right angles to the plane of FIG. 1.

The shifting member 34 comprises two coaxial portions or sections which are coupled to each other by a joint 30 enabling the right-hand section to turn with the turntable 19 relative to the left-hand section, i.e., relative to the roller follower 36.

The main purpose of the mouthpiece 41 is to insure that the leaders or second end portions of successive labels 1 enter the pocket 21 or 22 so that the front edge faces of such second end portions come into abutment with the inner end wall 26 of the pocket 21 or 22. This insures that the first end portions 52 of such labels extend radially outwardly and beyond the turntable 19. The pockets 21, 22 are shorter than the labels 1.

The component parts of the apparatus at the labelling station 6 include a horizontal supporting platform 42 for soft cigarette packs 2. Successive soft packs 2 (without labels) are transferred onto the platform 42 in a region to the right of the turntable 19, as viewed in FIG. 1, and such packs are thereupon moved through the labelling station 6, namely, in a direction to the left, as viewed in FIG. 1, and below the turntable 19, by a moving means including a reciprocable pusher 43 which may constitute a plate secured to the exposed end of the piston rod 43*b* of a piston which is installed in a double-acting cylinder, not shown. The manner in which successive unlabelled soft packs 2 are delivered onto the platform 42 substantially at right angles to the plane of FIG. 1 forms no part of the present invention. Another component of the labelling apparatus at the station 6 is a plate-like back support 44 which is mounted on an arm or lever 47 (see FIG. 3) and is pivotable about the axis of a horizontal shaft 46 which is adjacent to and parallel with the path of movement of packs 2 through the station 6, i.e., along the upper side of the platform 42. The back support 44 is movable between an operative position which is shown in FIG. 3 by broken lines and an inoperative or retracted position which is indicated by phantom lines. When in operative position, the back support 44 is located behind the first end portion 52 of a label 1 in that pocket (21 or 22) of the turntable 19 which extends downwardly, i.e., whose inner end wall 26 is adjacent to but is located at a level below the right-hand end portion of the hollow shaft 27.

Still further, the labelling station 6 accommodates additional instrumentalities for treating (deflecting) successive labels 1 during transport with the respective packs 2 through the station 6. Such additional instrumentalities include a plate-like horizontal deflecting member 48 which is stationary and is located immediately above the path of movement of soft packs 2 along the upper side of the platform 42. The aforementioned instrumentalities also include a folding member 51 which is reciprocable in directions indicated by a double-headed arrow 49. The means (e.g., a cam and roller follower system) for moving the folding member 51 up and down is not shown in the drawing.

The operation of the illustrated labelling apparatus is as follows:

A label 1 which is advanced by the feeding unit 3 is coated with adhesive during transport through the nip of the rollers 17, 18 and thereupon advances between the lips of the mouthpiece 41 so as to enter the upper pocket (e.g., the pocket 21) while the turntable 19 is idle. The cam 37 maintains the clamping device 33 is retracted position against the opposition of the biasing means 32 so that the leader or second end portion of the adhesive-coated label 1 can descend all the way into abutment with the inner end wall 26 of the pocket 21. Since the height of the pocket 21 is less than the length of the label 1, the first end portion 52 of such label projects upwardly beyond the turntable 19 and is disposed in the gap between the lips of the mouthpiece 41. In the next step, the cam 37 is rotated through a predetermined angle so that its lobe 37*a* allows a certain axial movement of the shifting member 34 in a direction to the left, as viewed in FIG. 1. This enables the spring or springs 32 to urge the legs 38, 39 of the clamping device 33 against the uncoated portions of the right-hand side of the label 1 in the pocket 21. As a rule, the uncoated portions of the right-hand side of the label 1 in the pocket 21 will be disposed along the marginal portions of the label. If desired, one side of the end portion 52 and one side of the other or second end portion of each label 1 can be coated with adhesive in its entirety. This insures that the label 1 is fixedly held against the wall 19*b* of the turntable 19.

The roll 10 is thereupon moved away from the associated roll 10*a* of the pair 11 so that the rolls 10, 10*a* release the first end portion 52 of the label 1 in the pocket 21. The rack 30 then performs a stroke at right angles to the plane of FIG. 1 so as to index the turntable 19 and the pockets 21, 22 through 180 degrees by way of the pinion 29 which transmits torque to the hollow shaft 27. The clamping device 33 turns with the pockets 21, 22 but the angular position of the roller follower 36 remains unchanged due to the provision of the joint 30. The orientation of the label 1 in the pocket 21 is thereby changed so that the first end portion 52 of such label is located at the station 6 to the right of the back support 44 which is held in the operative position. The back support 44 can be pivoted to its operative position prior or subsequent to indexing of the turntable 19 through 180 degrees.

A fresh soft pack 2 (without a label thereon) is located in front of the pusher 43 which is held in the retracted position of FIG. 1. As mentioned above, the soft pack 2 which is shown in front of the pusher 43 can be placed onto the platform 42 by moving it at right angles to the plane of FIG. 1. The moving means can include an indexible turret or any other conveyor which insures that a fresh pack 2 which moves onto the platform 42 can bypass the turntable 19 and is then located in front of the pusher 43. The piston rod 43*b* thereupon moves the pusher 43 in the direction of arrow 43*a* so that the left-hand major side or face 2*a* of the pack 2 immediately in front of the pusher 43 is moved toward the back support 44 and is thus attached to the first end portion 52 of the label 1 in the pocket 21. The platform 42 can be provided with lateral guide means 42*a* to thereby insure that the first end portion 52 of a label 1 in the lower pocket of the turntable 19 is attached to a predetermined portion of the major side 2*a* of the oncoming pack. This is desirable in order to insure that the labels 1 are attached to successive packs in identical orientation and position.

In the next step, the cam 37 is rotated so that its lobe 37*a* moves the shifting member 34 in a direction to the right, as viewed in FIG. 1, and causes the legs 38, 39 of the clamping device 33 to release the label 1 in the pocket 21. The spring or springs 32 then store energy. At the same time, the clamping device 33 allows a fresh label 1 (one side of which is already coated with adhesive) to enter the pocket 22 whose open outer end then faces upwardly so as to register with the mouthpiece 41. This is due to the fact that the clamping device 33 is common to both pockets of the turntable 19.

While the clamping device 33 is held in a position of disengagement from the label 1 in the pocket 21, the pusher 43 continues to advance in the direction of arrow 43*a* to thereby push the back support 44 (which is still in the operative position) toward the position 44' shown in FIG. 1. Thus, the back support 44 can move with or along the shaft 46 in the direction of arrow 43*a* to insure that the first end portion 52 of the label 1 adheres to and cannot change its position with respect to the major side 2*a* of the respective pack 2. As the pack 2 moves in the direction of the arrow 43*a*, the deflecting member 48 folds the median portion of the label 1 (which was withdrawn from the pocket 21) along the narrow upper side or face 2*b* of the pack 2. The back support 44 is movable with the pusher 43 in the direction of arrow 43*a* as well as in the opposite direction. This is indicated in FIG. 1 by the double-headed arrow 50.

The median portion of the label 1 which is deflected to engage (with its adhesive-coated side) the upper face 2*b* of the pack 2 is guided by the deflecting member 48 as well as by the lower edge face of the turntable 19 which is then idle. When the back support 44 reaches the position 44', the folding member 51 is caused to descend and to fold the other (second) end portion (namely the end portion which is remote from the first portion 52) so as to overlie the right-hand major side or face 2*c* of the pack 2. Such folding takes place subsequent to at least partial retraction of the pusher 43 to or even beyond the starting position of FIG. 1 so that the pusher cannot interfere with folding of the other (second) end portion over the major side or face 2*c*.

This completes the attachment of the label 1, which was withdrawn from the pocket 21, to the sides or faces 2*a*, 2*b*, 2*c* of the soft pack 2 which has been caused to advance through the station 6. The back support 44 is thereupon moved to the inoperative position by pivoting it about the axis of the shaft 46 in such a way that the back support has a component of movement in a downward direction, as viewed in FIG. 1, i.e., in a direction which is parallel to the longitudinal direction of a label 1 in the pocket 21 or 22. Such downward movement of the back support 44 ensures that the latter cannot change the orientation of the first end portion 52 during movement to the inoperative position. A spring or the like (shown in FIG. 3 by a broken-line circle 46*a*) thereupon returns the back support 44 to the right-hand end of its operative position, i.e., to the position of FIG. 1 in which the back support is ready to serve as a stop for the first end portion 52 of the next-following label 1.

The labelled packs 102 (shown on the left-hand portion) of the platform 42) are closely adjacent to each other so as to make sure that the adhesive at the inner sides of properly applied labels 101 can set before the packs 102 are removed from the platform to be forwarded to a carton filling machine, into storage, to a machine which confines successive packs 102 in transparent outer envelopes, or to another destination. The back support 44 is preferably thin and smooth so that it occupies a minimal amount of space, as considered in the direction of the arrow 43*a*.

The manner in which the back support 44 can be retracted to the position which is shown in FIG. 1 by solid lines has been described above. If desired, the spring 46*a* can be replaced with a reciprocating mechanism which is analogous to the mechanism 30, 34, 36, 37 for reciprocating the clamping device 33. It goes without saying that the pusher 43 is retracted to the starting position of FIG. 1 before the back support 44 is free to reenter the labelling station 6 subsequent to or even prior to renewed indexing of the turntable 19 so as to move the label in the pocket 22 in front of an oncoming unlabelled pack 2 before the pusher 43 begins to perform a forward stroke in the direction of arrow 43*a*.

The exact construction of means for synchronizing angular movements of the cam 37 with reciprocatory movements of the pusher 43, with movements of the back support 44 into and from the path of movement of soft packs 2 along the upper side of the platform 42, with reciprocatory movements of the rack 31, with movements of the folding member 51 and with movements of means for supplying labels 1 into the nip of the topmost pair of rollers 7 forms no part of the present invention.

The improved apparatus is susceptible of many further modifications. For example, the packs 2 or other substantially box-shaped or brick-shaped commodities can be fed onto the platform 42 in such a way that each label is applied to two side faces 2*d* and to the top face 2*b* of each commodity. This would merely amount to a modification of the means for supplying packs onto the platform 42, i.e., the packs would be delivered in a different orientation. Still further, the apparatus can be designed to apply relatively short, very long, relatively small or relatively large labels or other types of adherent sheet-like articles.

An important advantage of the improved apparatus is that the pusher 43 (with the pack 2 in front of such pusher) cooperates with the yieldable back support 44 to guarantee the application of the first end portion 52 of each and every label 1 in a predetermined orientation. The parts 43 and 44 further cooperate with the turntable 19 or an analogous carrier whose pockets 21 and 22 are shorter than the labels so that the first end portion 52 of each label necessarily extends from the respective pocket and its non-adherent side is located in front of the back support 44 before the oncoming soft pack 2 engages the adherent side of such first end portion 52. The pusher 43 thereupon cooperates with the back support 44 to ensure that the label 1 whose first end portion 52 adheres to the major side 2a of the adjacent pack 2 cannot be shifted relative to the major side 2a while the median portion and the other (second) end portion of the label are draped over the sides or faces 2b and 2c.

Another important advantage of the illustrated apparatus is that the turntable or carrier 19 comprises several pockets. This increases the output of the apparatus because a pocket can accept a label from the feeding unit 3 while another label is being applied or attached to the soft pack 2 which moves through and beyond the station 6. It has been found that the illustrated apparatus can process a large number of labels per unit of time and that the orientation of each and every label is the same even if the packs 2 are delivered to the platform 42 at frequent intervals.

The selected length of the pockets 21 and 22 (such pockets are shorter than the labels 1) renders it possible to automatically insert each label in such a way that its first end portion 52 is fully exposed, i.e., the non-adherenet side of such first end portion can abut against the back support 44 and the adherent side of the same first end portion is attached to the oncoming pack 2 when the respective pocket 21 or 22 is located in immediate proximity of the station 6.

As a rule, the paster 12 applies adhesive to the central portion of one side of each label 1, i.e., the marginal portions of the one side of each label remain uncoated (non-adherent) so that there is ample room for engagement of the exposed side by the legs 38, 39 which abut against the non-adherent portions of such exposed side. One side of each label in the pocket 21 or 22 is exposed because the pockets are open not only at their outer ends but also at those sides which face the clamping device 33.

A further advantage of the improved apparatus is that the back support 44 is movable with the packs 2 while the packs advance through the station 6. This ensures that the back support 44 cooperates with the pusher 43 to prevent any shifting of the label whose first end portion 52 is already attached to the respective pack 2 while the instrumentalities 48 and 51 deform the remaining portions of the label, i.e, while the instrumentality 48 folds the median portion and the instrumentality 51 folds the second end portion of the label whose first end portion 52 is clamped between the back support 44 and the major side 2a of the respective pack 2.

The provision of a relatively long platform 42 is desirable and advantageous because it allows the adhesive on the labels 101 which surround the sides or faces 2a, 2b, 2c of the respective packs 102 to set before the packs 102 are removed for further processing. Thus, each pack 102 which is ready to be removed from the platform 42 carries a U-shaped label 101 which adheres to the pack with sufficient force to prevent or reduce the likelihood of any misorientation of labels during further processing. The mounting of the means (arm 47) for moving the back support 44 into and from the path of movement of soft packs 2 in such a way that the back support moves substantially downwardly, as viewed in FIG. 1 or 3, during removal from the path for the packs 2 is also desirable and advantageous because the back support cannot change the orientation of the first end portion 52 of the label while it moves downwardly and away from the path to be reinserted into such path upon return movement in a direction to the right, as viewed in FIG. 1. A label which already adheres to the respective pack 2 or 102 is most likely to be misoriented in response to the application of shifting forces acting at right angles or substantially at right angles to its longitudinal direction. This is the reason for withdrawal of the back support 44 (from the position 44') in such a way that the back support moves downwardly, i.e., in the longitudinal direction of the labels 1. It will be noted that the axis of the shaft 46 for the arm 47 is laterally adjacent to the path of movement of the packs 2, 102 and is parallel or nearly parallel to the direction of movement of packs 2, 102 along the platform 42.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In an apparatus for attaching flexible sheets of the type having adherent and non-adherent sides and first and second end portions to block-shaped commodities, particularly for applying labels to packs of cigarettes or the like, the combination of means defining a station for attachment of successive sheets to successive commodities; means for feeding successive sheets toward but short of said station; means for transferring successive sheets from said feeding means to successive commodities at said station, including carrier means which leaves exposed both sides of the first end portin of each sheet which is being transferred to said station; a back support disposed at said station and adjacent to the non-adherent side of said first end portion of the sheet which is delivered by said transferring means, said carrier means comprising a turntable indexible about a predetermined axis and having at least one receiving means for sheets, said receiving means being positioned to receive a sheet from said feeding means in a first angular position of said turntable and to maintain the first end portion of such sheet in register with said back support in a different second angular position of said turntable; and means for moving successive commodities against the adherent sides of the first end portions of sheets abutting against said back support.

2. The combination of claim 1, wherein said moving means comprises means for conveying successive commodities through said station in a predetermined direction and along a predetermined path and further comprising means for moving said back support into and from said path, said back support being movable with successive commodities along a portion of said path while a commodity is conveyed in said direction so that the adherent side of the first end portion of the sheet which abuts against said back support is held in contact with the respective commodity.

3. The combination of claim 2, wherein said a turntable is indexible through angles of 180 degrees and has first and second receiving means for discrete sheets, said receiving means being located diametrically opposite each other with reference to said axis and one thereof being in a position to receive a sheet from said feeding means when the other thereof maintains the first end portion of a sheet therein in register with said back support in a first angular position of said turntable, said other receiving means being in a position to receive a sheet from said feeding means and said one receiving means being in a position to maintain the first end portion of the sheet therein in register with said back support when said turntable is indexed from said first angular position to the next angular position.

4. The combination of claim 1, wherein said receiving means includes a pocket which has an open end for admission of a sheet into its interior.

5. The combination of claim 4 for attaching sheets having a predetermined length, wherein said pocket is elongated and its length is less than said predetermined length so that said first end portion of a sheet which is inserted into said pocket extends outwardly beyond said open end.

6. The combination of claim 5, wherein said pocket has an inner end wall which constitutes an abutment for the second end portion of a sheet therein and two side walls which flank the inserted portion of the sheet in said pocket.

7. The combination of claim 4, further comprising means for releasably urging a sheet in said pocket against said turntable while said turntable is indexed about said axis.

8. The combination of claim 7, wherein said urging means comprises a clamping device and means for moving said clamping device toward and away from a sheet in said pocket.

9. The combination of claim 8 for attaching sheets of the type wherein said adherent side includes non-adherent portions, said clamping device including projections which engage said non-adherent portions of said adherent side of the sheet in said pocket.

10. The combination of claim 2, further comprising guide means for sheets interposed between said feeding means and said transferring means.

11. The combination of claim 10, wherein said guide means includes a mouthpiece.

12. The combination of claim 2, further comprising sheet-deflecting instrumentalities at said station, said instrumentalities being operative to move the adherent sides of the second end portion and of the portion between the first and second end portions of a sheet against the respective commodity.

13. The combination of claim 12, wherein said additional instrumentalities include stationary and mobile instrumentalities.

14. The combination of claim 2, wherein said back support is pivotable into and from said path about a predetermined axis which is substantially parallel to said direction.

15. The combination of claim 14, wherein said means for moving said back support includes means for imparting to said back support a component of movement which is substantially parallel to the direction of delivery of sheets by said feeding means while said back support moves from said path.

16. The combination of claim 1, wherein said defining means includes a platform and said means for moving the commodities includes a pusher which is operative to advance the commodities along said platform.

17. The combination of claim 1, wherein said feeding means includes a plurality of pairwise arranged advancing rolls defining a substantially vertical path for downward movement of successive sheets toward said station.

18. The combination of claim 1, further comprising means for applying adhesive paste to said one side of each sheet during transport of such sheet by said feeding means.

19. The combination of claim 1, wherein said station is located at a level below said transferring means.

20. The combination of claim 1, wherein said turntable includes several sheet receiving means.

* * * * *